United States Patent [19]

Nishikubo

[11] 4,333,171

[45] Jun. 1, 1982

[54] ELECTRONIC TIMEPIECE WITH DIFFUSION RESISTOR FOR COMPENSATING THRESHOLD VARIATIONS

[75] Inventor: Yasuhiko Nishikubo, Tokorozawa, Japan

[73] Assignee: Citizen Watch Co., Ltd., Tokyo, Japan

[21] Appl. No.: 181,764

[22] Filed: Aug. 27, 1980

[30] Foreign Application Priority Data

Sep. 4, 1979 [JP] Japan ..... 54-113166
Sep. 4, 1979 [JP] Japan ..... 54-113167

[51] Int. Cl.[3] ..... G04C 3/00; G04C 5/00
[52] U.S. Cl. ..... 368/87; 357/42; 357/51; 368/219
[58] Field of Search ..... 357/42, 51; 368/87, 368/219, 155

[56] References Cited

U.S. PATENT DOCUMENTS 3,905,188 9/1975 Nishikubo et al. ..... 357/51
4,100,565 7/1978 Khajezadeh et al. ..... 357/51
4,300,061 11/1981 Mihalich et al. ..... 357/42

*Primary Examiner*—B. A. Reynolds
*Assistant Examiner*—Bernard Roskoski
*Attorney, Agent, or Firm*—Birch, Stewart, Kolasch and Birch

[57] ABSTRACT

An electronic timepiece comprising a quartz crystal oscillator for producing a time standard signal, a frequency divider, and a display driver. The electronic circuit comprises a digital logic circuit employing a complementary MOS integrated circuit (CMOS·IC). A diffusion resistor is formed in the N-type substrate of the CMOS transistor of the CMOS·IC by diffusing an impurity at the same time with the diffusion of the P-well for the N-channel MOS transistor of the CMOS transistor. Supply voltage of a battery is supplied to a part of the CMOS·IC through the diffusion resistor, whereby variation of the threshold voltage of the CMOST may be compensated.

3 Claims, 11 Drawing Figures

ELECTRONIC TIMEPIECE WITH DIFFUSION RESISTOR FOR COMPENSATING THRESHOLD VARIATIONS

BACKGROUND OF THE INVENTION

The present invention relates to an electronic timepiece and more particularly to an electronic timepiece comprising a quartz crystal oscillator for producing a time standard signal and a frequency divider for dividing the frequency of the time standard signal to predetermined frequencies for driving a time display device. Such an electronic circuit employs a digital logic circuit comprising the complementary MOS transistor (hereinafter called as CMOST).

A conventional quartz crystal electronic timepiece comprises, as shown in FIG. 1, an quartz crystal oscillator 1, a frequency divider 2, a display driver 3 and a display device 4. Supply voltage is uniformly applied to each electronic circuit from a battery 10.

In the prior art, the voltage of the battery is applied to a part of the electronic circuit, such as the display driver and the display device which requires a comparatively higher voltage, and a lower voltage than the voltage of the battery is applied to the other part of the circuit, so that power consumption may be decreased. To this end, a CMOST in the lower voltage zone of the integrated circuit is made to have a lower threshold voltage. However, the produced CMOST does not always have a constant threshold voltage, because the voltage varies according to a slight difference in product condition.

SUMMARY OF THE INVENTION

The object of the present invention is to provide an electronic circuit in which variation of threshold voltage of the CMOST may be compensated. In accordance with the present invention, the supply voltage of the battery is decreased by a resistor formed in a complementary MOS integrated circuit (hereinafter called a CMOS·IC) to a proper lower voltage. The resistor is formed by diffusing an impurity at the same time with the diffusion for forming the P-well in the N-type substrate for the N-channel MOST.

According to the present invention there is provided an electronic timepiece comprising an oscillator for producing a time standard signal, a frequency divider for dividing the output signal of said oscillator, a display driver, said electronic circuit units being composed of a CMOS integrated circuit, a display device, a voltage supply, a resistor formed in the N-type substrate of the CMOS transistor of said CMOS integrated circuit at the same time with the diffusion of the P-well for the N-channel MOS transistor of said CMOS transistor, and a voltage supply circuit for supplying the supply voltage from said voltage supply to a part of said CMOS integrated circuit through said resistor.

Other objects and advantages will become apparent from the following description with reference to the accompanying drawings.

DESCRIPTION OF THE PREFERRED EMBODIMENTS

Figure 1:
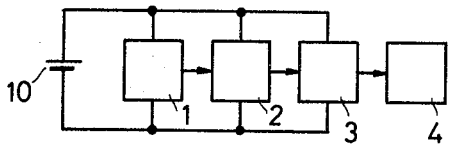
FIG. 1 is a block diagram showing a conventional quartz crystal electronic timepiece.
Figure 2:
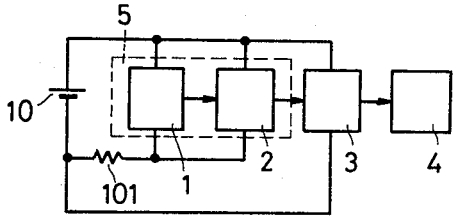
FIG. 2 is a block diagram showing a quartz crystal electronic timepiece according to the present invention.
Figure 3:
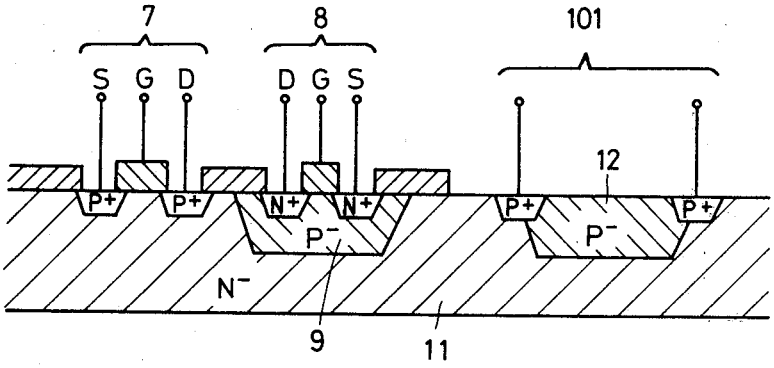
FIG. 3 is a sectional view showing a part of a CMOS·IC according to the present invention.

Referring to FIG. 2 showing an example of the present invention, a lower voltage zone 5 comprising the oscillator 1 and the frequency divider 2 is supplied with a lower voltage through a resistor 101 connected in series to the lower voltage side of the battery 10. The display driver 3 is supplied with the supply voltage of the battery 10 to drive the display device 4. Electronic circuits for the oscillator 1, frequency divider 2 and display driver 3 employ a CMOS·IC comprising a plurality of CMOS transistors. The resistor 101 is formed by diffusing an impurity in the N-type substrate of the N-channel MOST at the same time with the diffusion for forming the P-well for the CMOS·IC. FIG. 3 shows a construction of a CMOST and resistor 101. The CMOST comprises a P-channel MOST 7 and N-channel MOST 8. The N-channel MOST 8 is formed in a P-well 9 formed by diffusing an impurity in a N-type substrate 11. The resistor 101 comprises a P-well 12 formed at the same time with the diffusion of the P-well 9.

It has been found that there are some relations between the resistance of the diffusion resistor and characteristics of the CMOST when the diffusion resistor is formed at the same time with the CMOST. In an electronic timepiece, the CMOS·IC is designed to have a threshold voltage of 0.4 V–0.6 V. In such a CMOS·IC, impurity concentration of the P-well is $1\times10^{16}/cm^3$ and sheet resistivity is 5–6KΩ/□.

Figure 4:
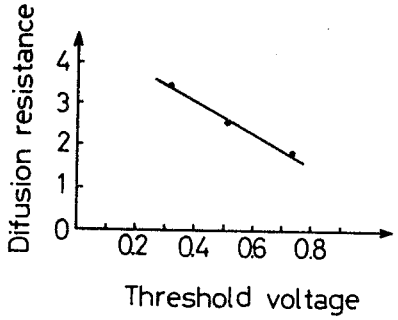
FIG. 4 is a graph showing a relation between the threshold voltage of the CMOST and the diffusion resistance thereof.

FIG. 4 shows the relation between the diffusion resistance R and the threshold voltage of a CMOST in a CMOS·IC. The mask pattern of the diffusion resistor has a dimension of $10\mu\times5000\mu$ and a diffusion depth of $7\mu$. As shown in FIG. 4, when a produced CMOST has a higher threshold voltage, the diffusion resistor formed on the substrate of the CMOST has a lower resistance, and the threshold voltage decreases as the diffusion resistance of a produced CMOST increases. Accordingly, a CMOST having a lower threshold voltage is supplied with a lower voltage decreased by the diffusion resistor corresponding to the lower threshold voltage, and when the CMOST has a higher threshold voltage, a higher voltage corresponding to the threshold voltage is supplied to the CMOST.

Figure 5:
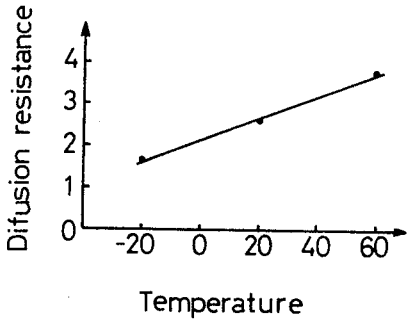
FIG. 5 is a graph showing a relation between the temperature and the diffusion resistance.
Figure 6:
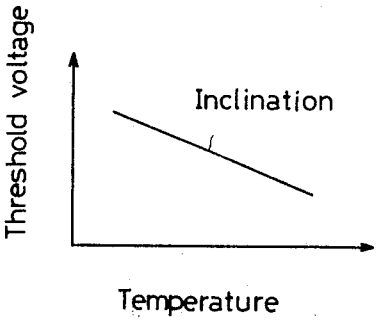
FIG. 6 is a graph showing a relation between the temperature and the threshold voltage.

The CMOS·IC has further a preferable temperature characteristic. FIG. 5 shows relation between the temperature and the diffusion resistance R of MOST and FIG. 6 shows relation between the temperature and the threshold voltage. The diffusion resistance increases with the increase of the temperature and the threshold voltage decreases as the temperature increases. Therefore, the entire impedance of the CMOS-IC is constant in spite of the temperature variation, so that the current consumption and the minimum operating voltage of the circuit are constant.

Figure 7:
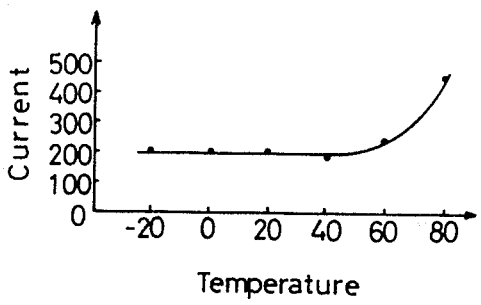
FIG. 7 is a graph showing a relation between the temperature and the current flowing the CMOS·IC.

FIG. 7 shows the current vs. the temperature. It will be seen that the current consumption is constant in the practical temperature range.

Figure 8:
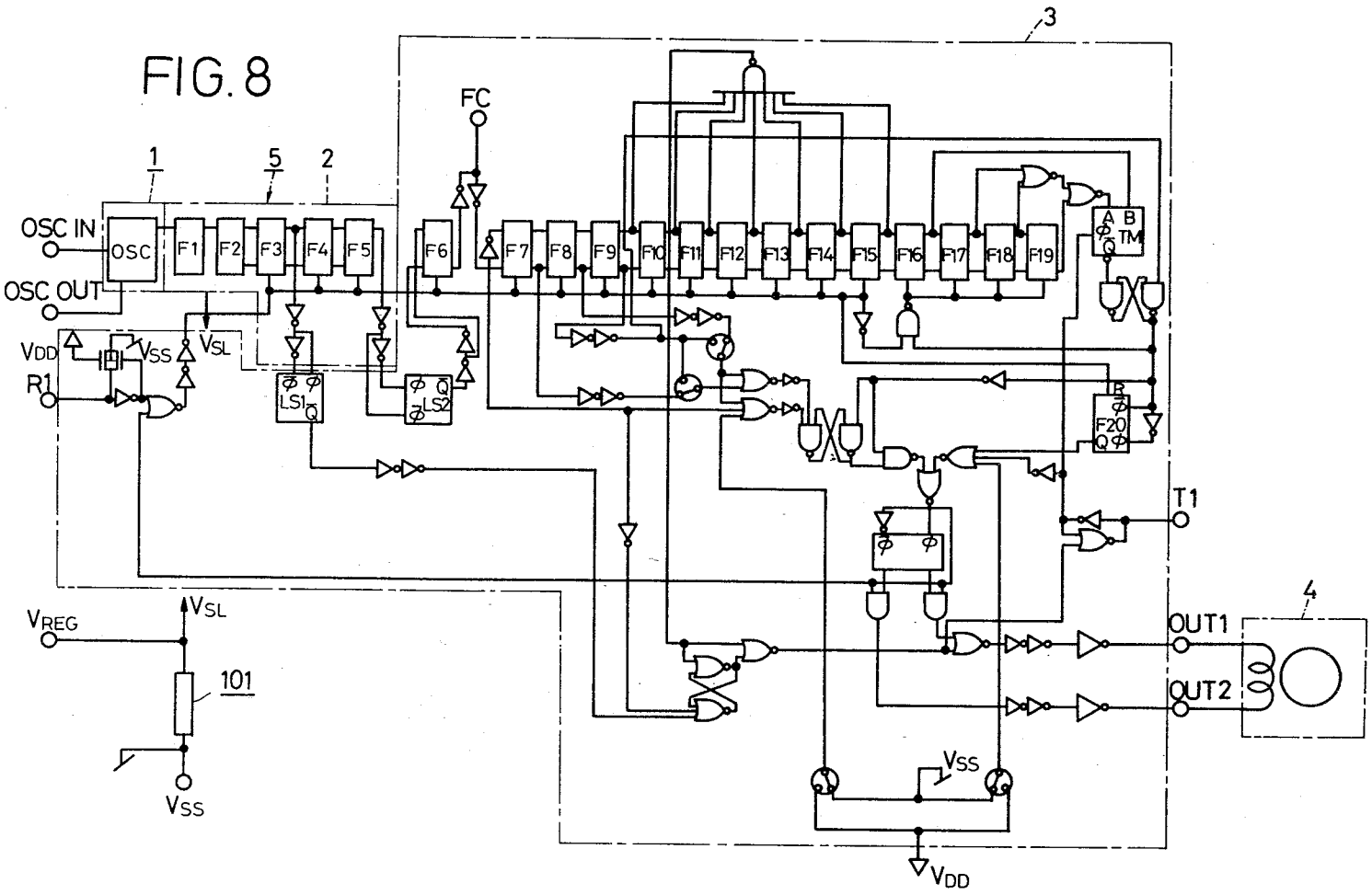
FIG. 8 shows an example of the electronic circuit for an electronic timepiece according to the present invention.

FIG. 8 shows an example of an electronic circuit using the circuit of the present invention, which is for an electronic timepiece with an analogue display device. The end $V_{SL}$ of the diffusion resistor 101 is connected to the end $V_{SL}$ of the lower voltage zone 5. Signal transfer from the lower voltage zone 5 to the higher voltage zone 3 is performed through level shifts $LS_1$ and $LS_2$. It will be understood that the present invention may be applied to a digital display electronic timepiece.

Figure 9:
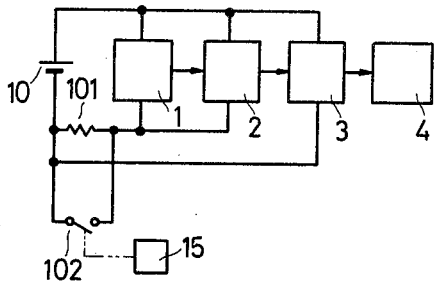
FIG. 9 shows another embodiment of the present invention.

FIG. 9 shows another embodiment of the present invention. A switch 102 is connected in parallel across diffusion resistor 101 for short-circuiting the resistor. At a time which requires a greater amount of power, such as starting of the timepiece, lighting of a lamp, and driving of an alarm device, the supply voltage from the battery decreases. The switch 102 is closed by an electronic means 15 or a mechanical means when the supply voltage decreases. The electronic means is constructed, for example, by a MOST switch actuated by a signal from a detecting circuit.

Figure 10:
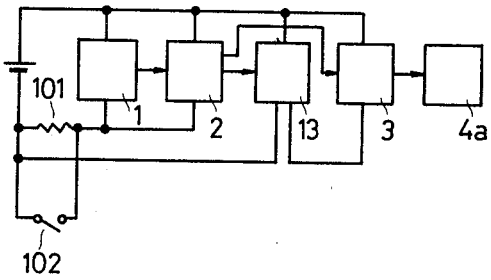
FIGS. 10 and 11 show further embodiments of the present invention, respectively.

FIG. 10 shows a further embodiment of the present invention. The timepiece is provided with a liquid crystal display device 4*a*. The liquid crystal display device is driven by a higher voltage stepped up by a booster means 13.

Figure 11:
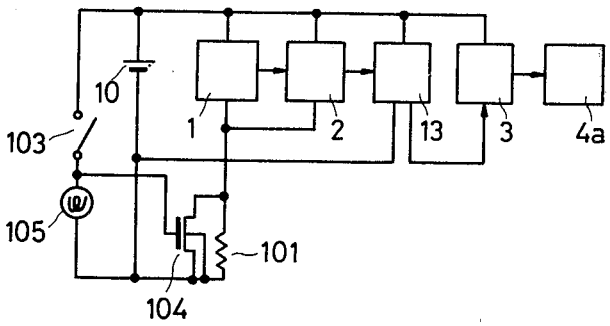

FIG. 11 shows an example of a switch actuating means. The electronic timepiece is provided with a lamp 105, a manual switch 103 for the lamp 105 and a MOST switch 104. When the switch 103 is closed to light the lamp, an input is applied to the gate of the MOST switch 104, so that the resistor 101 is short-circuited.

In accordance with the present invention, the timepiece using the electronic circuit of the present invention has the substantially same power consumption in every product in spite of variation of threshold voltage and the power consumption may be decreased to a desired degree. Further, the current consumption and the minimum operating voltage of the circuit are constant to the temperature.

What is claimed is:

1. An electronic timepiece comprising:

an electronic circuit unit including, an oscillator for producing a time standard signal, a frequency divider for dividing the output signal of said oscillator, and a display driver, said electronic circuit unit being composed of a CMOS integrated circuit;

a display device connected to said electronic circuit unit, a voltage supply connected to said electronic circuit unit;

a resistor formed in the N-type substrate of a CMOS transistor within said CMOS integrated circuit at the same time with the diffusion of the P-well for the N-channel MOS transistor of said CMOS transistor, and a voltage supply circuit including said resistor and connecting the voltage supply to said electronic circuit unit for supplying the supply voltage from said voltage supply to a part of said CMOS integrated circuit via said resistor.

2. An electronic timepiece according to claim 1 wherein said CMOS integrated circuit comprises a CMOS transistor having a lower threshold voltage than the other CMOS transistor and said voltage supply circuit is arranged to supply the supply voltage to said CMOS transistor having a lower threshold voltage through said resistor.

3. An electronic timepiece according to claim 1 further comprising a switch for short-circuiting said resistor, and means for closing said switch when the supply voltage decreases.

* * * * *